US005121736A

United States Patent [19]

Hawk

[11] Patent Number: 5,121,736

[45] Date of Patent: Jun. 16, 1992

[54] ARCHERY BOW SIGHTING-TUNING APPARATUS

[76] Inventor: Gary L. Hawk, 1880 Alcan Dr., Medford, Oreg. 97504

[21] Appl. No.: 699,638

[22] Filed: May 14, 1991

[51] Int. Cl.[5] ..... F41B 5/00

[52] U.S. Cl. ..... 124/86; 124/87; 124/88; 182/182; 248/163.1

[58] Field of Search ..... 124/1, 23.1, 24.1, 80, 124/86-90; 248/163.1; 182/182; 73/167

[56] References Cited

U.S. PATENT DOCUMENTS

| | | | |
|---|---|---|---|
| 4,993,397 | 2/1991 | Cryar et al. | 124/23.1 |
| 5,022,377 | 6/1991 | Stevens | 124/23.1 |
| 5,048,504 | 9/1991 | Ballard | 124/86 |

FOREIGN PATENT DOCUMENTS

| | | | |
|---|---|---|---|
| 274581 | 2/1966 | Australia | 182/182 |

*Primary Examiner*—Randolph A. Reese
*Assistant Examiner*—John A. Ricci
*Attorney, Agent, or Firm*—Leon Gilden

[57] ABSTRACT

A sighting apparatus includes a framework mounting a forward and rear post vertically adjustable to accommodate height of an individual, with an upper support beam mounted to each upper terminal end of each post. The support beam including a forward plate for mounting the bow thereon, and including a plurality of guide rods positioned on opposed sides of the support beam, with a central drive screw arranged for selective retraction of the bow string of the associated bow. The organization includes a plumb bob and bow angulating member to effect vertical alignment of the bow, with the bow string arranged for retraction and subsequent release to effect flight of an associated archery arrow from the apparatus in an aligned orientation for sighting of the bow.

7 Claims, 9 Drawing Sheets

ARCHERY BOW SIGHTING-TUNING APPARATUS

BACKGROUND OF THE INVENTION

1. Field of the Invention

The field of invention relates to archery sighting apparatus, and more particularly pertains to new and improved archery bow sighting apparatus wherein the same is arranged for proper sighting and mounting of an archery bow and associated arrow arrangement.

2. Description of the Prior Art

To provide efficiency and a repetitive cycling of arrow shooting from an associated bow structure, an individual is frequently required to spend endless hours at an archery range to effect this purpose. The instant invention attempts to overcome deficiencies of the prior art by providing a convenient structure to permit a target shooter proper understanding of a bow in association to arrow projection therefrom.

Various prior art structure for use in archery equipment is available in the prior art, but have heretofore failed to provide a sighting-in structure as set forth by the instant invention. Examples of the prior art include U.S. Pat. No. 3,866,592 to Carella setting forth an archery release indicating assembly to provide a signal upon predetermined tensioning of an associated bow string.

U.S. Pat. No. 4,103,807 to Lyon, et al. sets forth a holster structure for mounting a bow therewithin.

U.S. Pat. No. 4,846,140 to Dimartino and U.S. Pat. No. 4,621,752 to Youngbauer set forth bow holsters for ulilization by individuals engaged in archery.

As such, it may be appreciated that there continues to be a need for a new and improved archery bow sighting apparatus as set forth by the instant invention which addresses both the problems of ease of use as well as effectiveness in construction for repetitive understanding of archery bow shooting and sighting apparatus and in this respect, the present invention substantially fulfills this need.

SUMMARY OF THE INVENTION

In view of the foregoing disadvantages inherent in the known types of archery equipment now present in the prior art, the present invention provides an archery bow sighting apparatus wherein the same is arranged for precise retraction and release of an associated bow string relative to an associated bow for projection of an arrow therefrom. As such, the general purpose of the present invention, which will be described subsequently in greater detail, is to provide a new and improved archery bow sighting apparatus which has all the advantages of the prior art archery equipment and none of the disadvantages.

To attain this, the present invention provides a sighting apparatus including a framework mounting a forward and rear post vertically adjustable to accommodate height of an individual, with an upper support beam mounted to each upper terminal end of each post. The support beam including a forward plate for mounting the bow thereon, and including a plurality of guide rods positioned on opposed sides of the support beam, with a central drive screw arranged for selective retraction of the bow string of the associated bow. The organization includes a plumb bob and bow angulating member to effect vertical alignment of the bow, with the bow string arranged for retraction and subsequent release to effect flight of an associated archery arrow from the apparatus in an aligned orientation for sighting of the bow.

My invention resides not in any one of these features per se, but rather in the particular combination of all of them herein disclosed and claimed and it is distinguished from the prior art in this particular combination of all its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basic for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow sighting apparatus which has all the advantages of the prior art equipment and none of the disadvantages.

It is another object of the present invention to provide a new and improved archery bow sighting apparatus which may be easily and efficiently manufactured and marketed.

It is a further object of the present invention to provide a new and improved archery bow sighting apparatus which is of a durable and reliable construction.

An even further object of the present invention is to provide a new and improved archery bow sighting apparatus which is susceptible of a low cost of manufacture with regard to both materials and labor, and which accordingly is then susceptible of low prices of sale to the consuming public, thereby making such archery bow sighting apparatus economically available to the buying public.

Still yet another object of the present invention is to provide a new and improved archery bow sighting apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view, taken along the lines 1—1 of FIG. 10 in the direction indicated by the arrows.

FIG. 2 is an orthographic view, taken along the lines 2—2 of FIG. 10 in the direction indicated by the arrows.

FIG. 8 is an orthographic top view of the support of the instant invention utilizing an alternative use of pneumatic or gear drive mechanism to effect retraction of the associated bow string retraction member.

FIG. 10 is an orthographic side view, taken in elevation, of the instant invention.

DESCRIPTION OF THE PREFERRED EMBODIMENT

Figure 11:
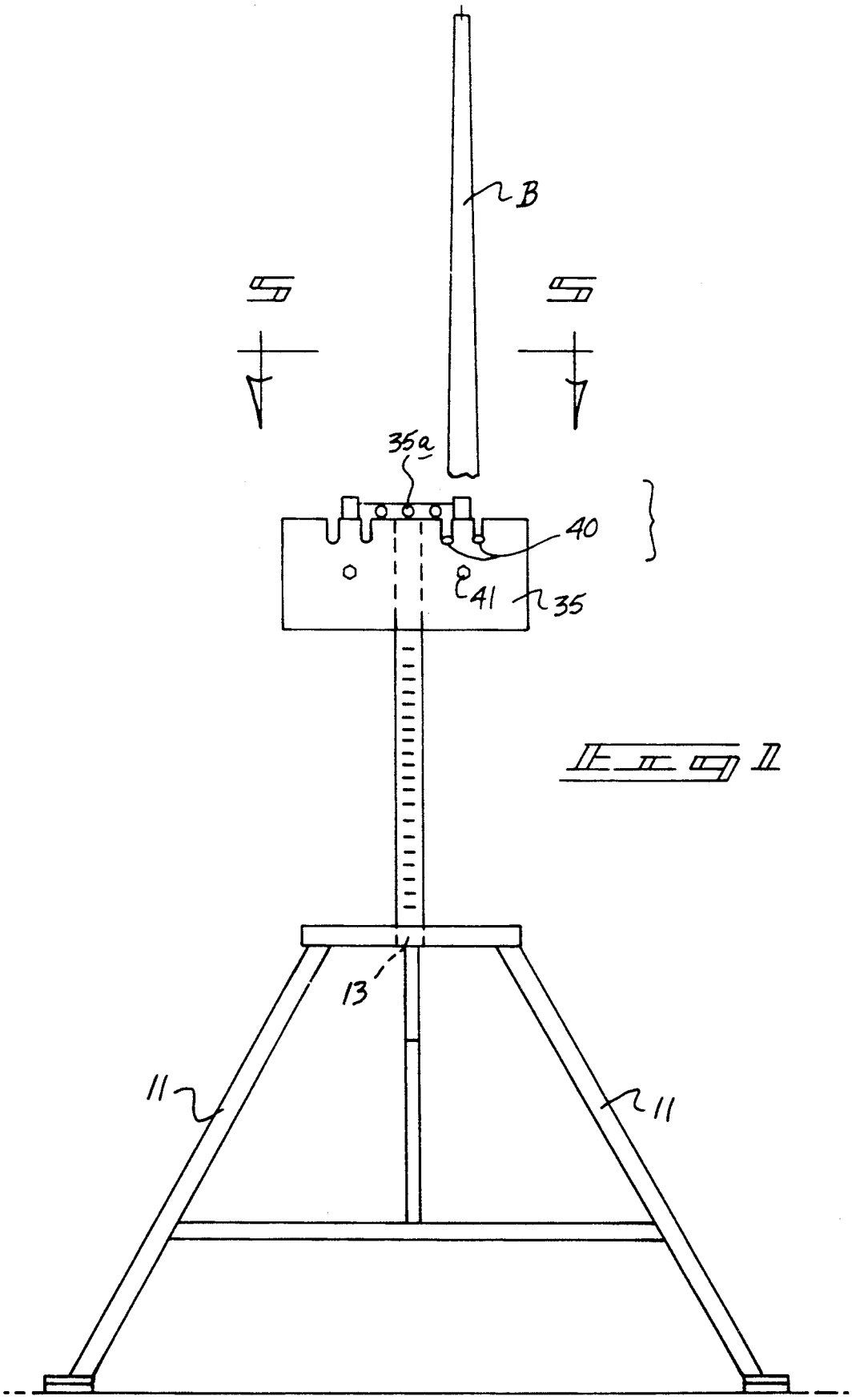

With reference now to the drawings, and in particular to FIGS. 1 to 10 thereof, a new and improved archery bow sighting apparatus embodying the principles and concepts of the present invention and generally designated by the reference numeral 10 will be described.

Figure 3:
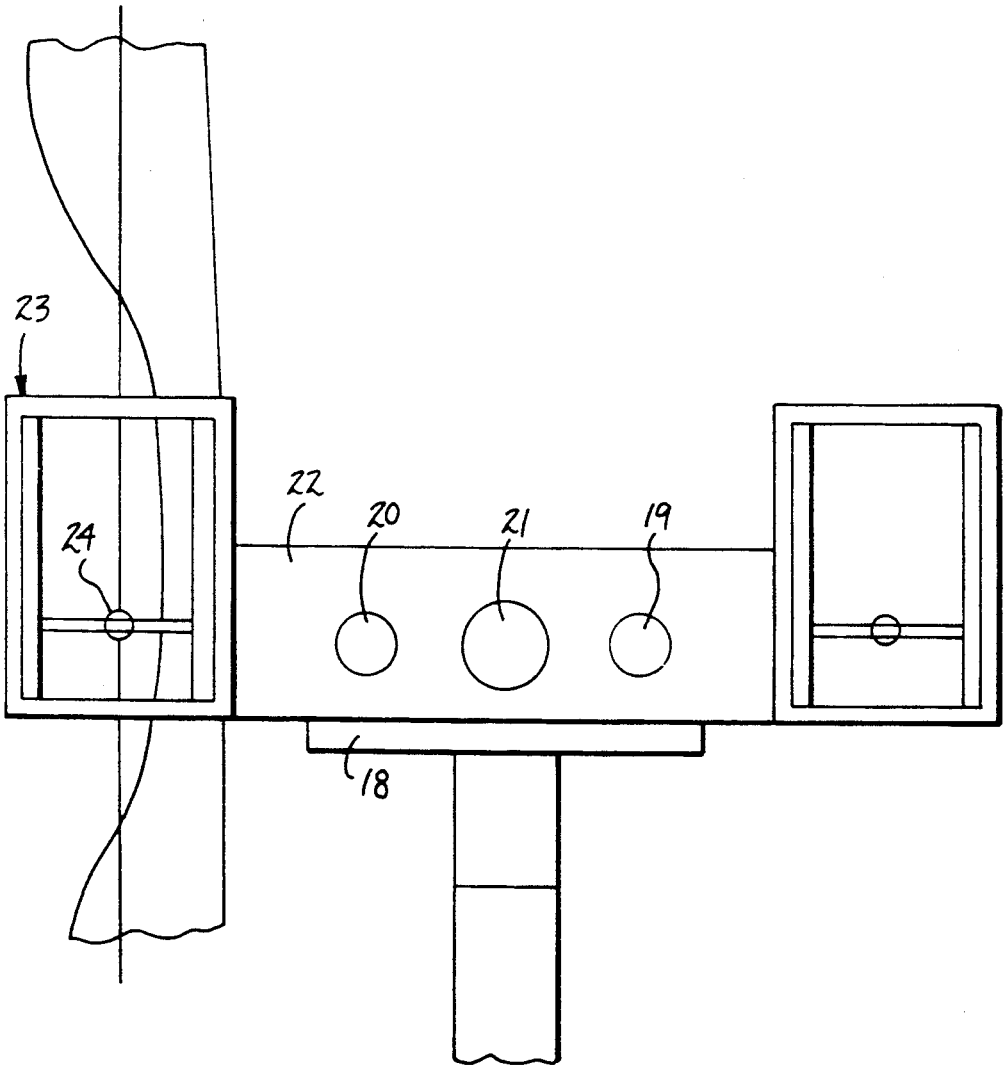
FIG. 3 is an orthographic view, taken along the lines 3—3 of FIG. 10 in the direction indicated by the arrows.
Figure 4:
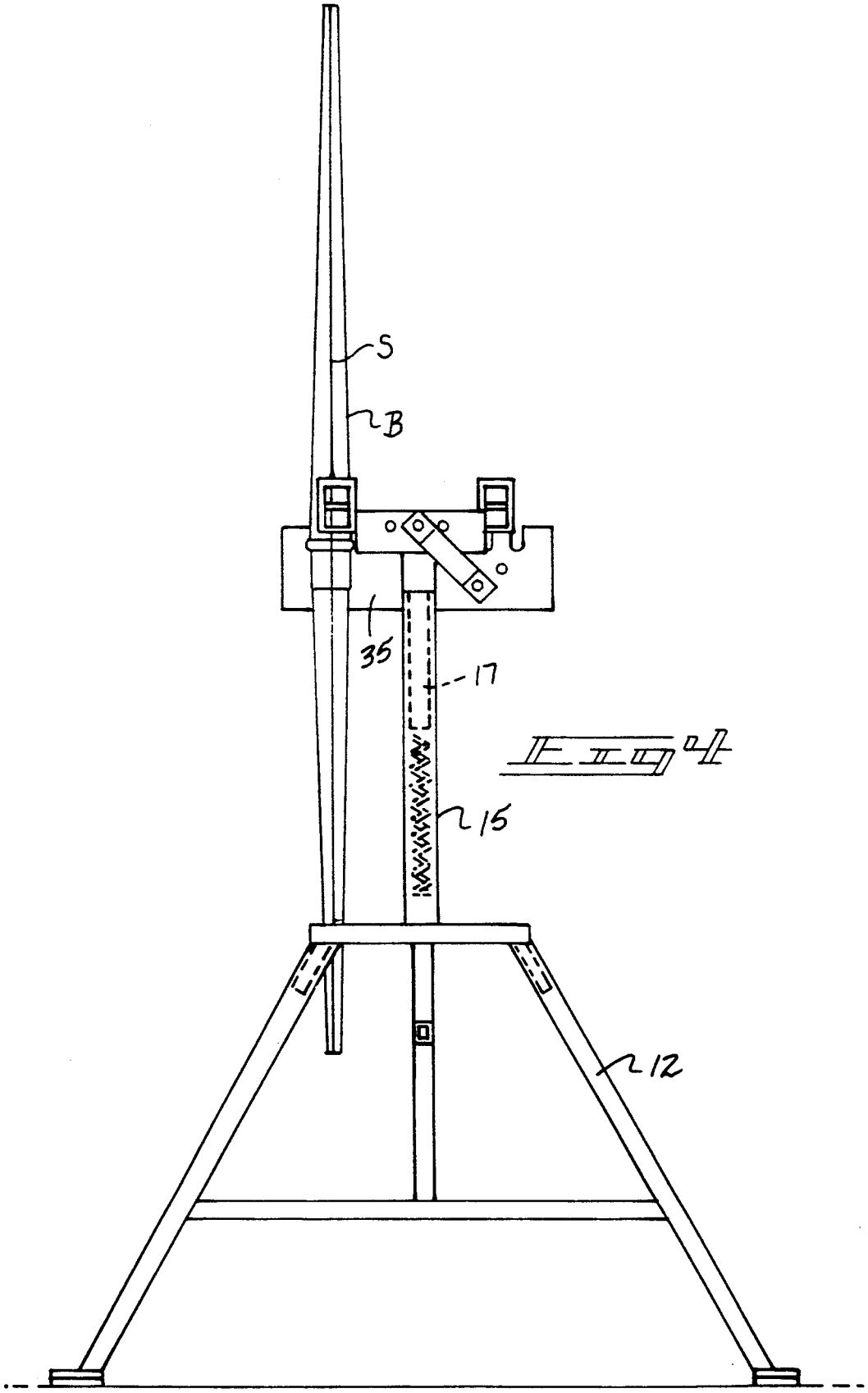
FIG. 4 is an orthographic view, taken along the lines 4—4 of FIG. 10 in the direction indicated by the arrows.
Figure 9:
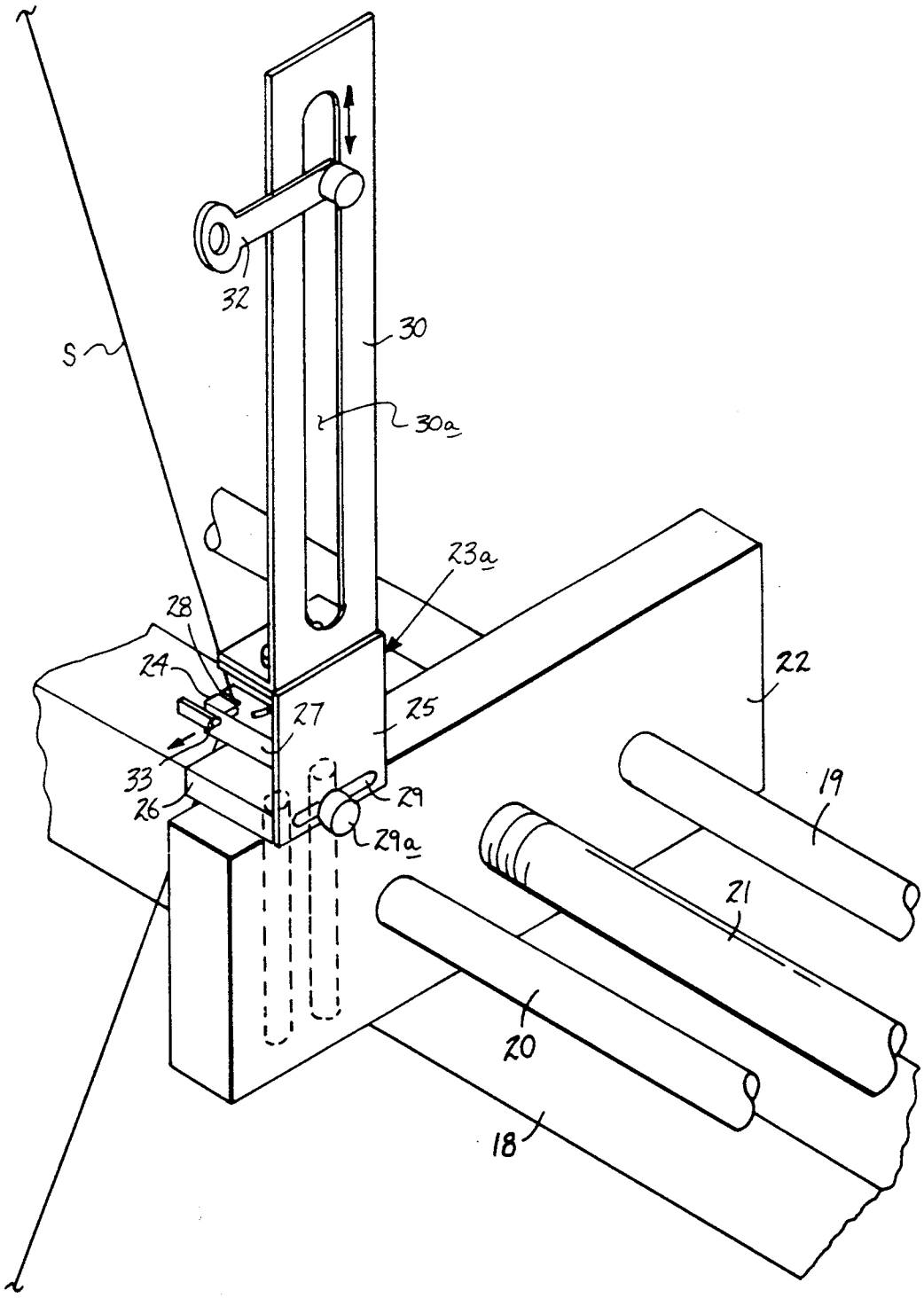
FIG. 9 is an isometric illustration of the retraction member utilized by the instant invention in association with the support structure of the instant invention.
Figure 11:
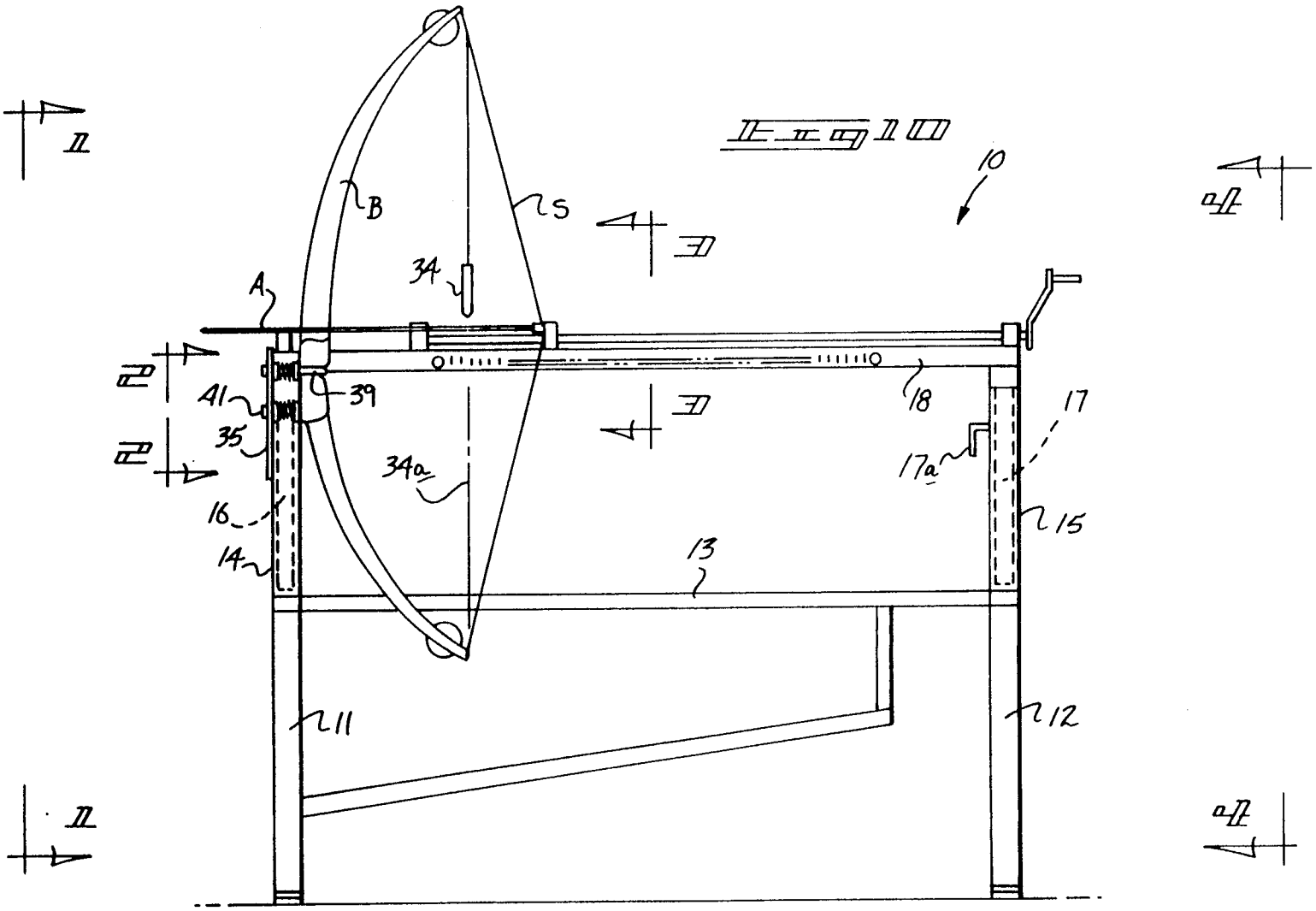

More specifically, the archery bow sighting apparatus 10 of the invention essentially comprises a framework defined by a plurality of front legs 11 spaced from and parallel a plurality of rear legs 12. A horizontal support beam 13 is mounted orthogonally between the front and rear legs 11 and 12, with a front and rear vertical post 14 and 15 respectively mounted medially to the lower horizontal support beam 13 in a coplanar relationship relative to the respective front and rear legs 11 and 12. Each of the front and rear vertical posts 14 and 15 respectively include a respective front and rear telescoping leg 16 and 17 mounted therewithin, A lock rod 17*a* is orthogonally directed through each vertical post to effect vertical positioning of each telescoping leg within a respective post. A top horizontal support beam 18 is orthogonally mounted to each upper terminal end of the respective front and rear telescoping legs 16 and 17 to permit vertical adjustment of the top horizontal support beam 18 to accommodate individual archery shooters to permit their sighting along the top horizontal support beam 18. The top horizontal support beam 18 mounts a respective right guide rail 19 and a left guide rail 20 in parallel relatioship relative to one another and on opposed longitudinal sides of the top horizontal support beam 18, in a manner as illustrated in FIGS. 8, 9, and 10. A central drive screw 21 is positioned medially of and parallel to the right and left guide rails 19 and 20 and is threadedly directed through a bow string retraction member 23. Retraction member 23, as illustrated in FIG. 3 for example, utilizes a tensioning block 22 receiving the right guide rail 19, the left guide rail 20, and the central drive screw 21 therethrough. The retraction member 23 includes a string release member 24 for securement and retraction of the associated bow string therewithin. FIG. 9 illustrates a modified bow string retraction member 23*a* that includes a retraction member vertical plate 25 orthogonally mounted to a retraction member lower horizontal support plate 26 that is fixedly mounted to a top surface of the tensioning block 22. A retraction member upper horizontal support plate 27 is spaced above and parallel the lower horizontal support plate 26, and includes a receiving slot 28 to receive the low bow string therewithin. An adjusting slot and lock screw 29 and 29*a* respectively permit lateral displacement of the retraction member vertical plate 25 relative to the retraction member lower horizontal plate 26, as illustrated in FIG. 9. A peep sight vertical support plate 30 mounted parallel to and above the vertical plate 25 includes a support blade slot 31 positioned medially thereof to adjustably mount a peep sight member 32 therewithin that is directed laterally of the slot 31 for sighting of the arrow "A" relative to the associated bow structure "B" upon release of the arrow relative to the bow "B" as illustrated in FIG. 10. A release pin 33 directed releasably into the upper horizontal support plate 27 maintains the bow string "S" within the slot 28 prior to retraction of the pin 33 relative to the slot.

Figures 6, 7:
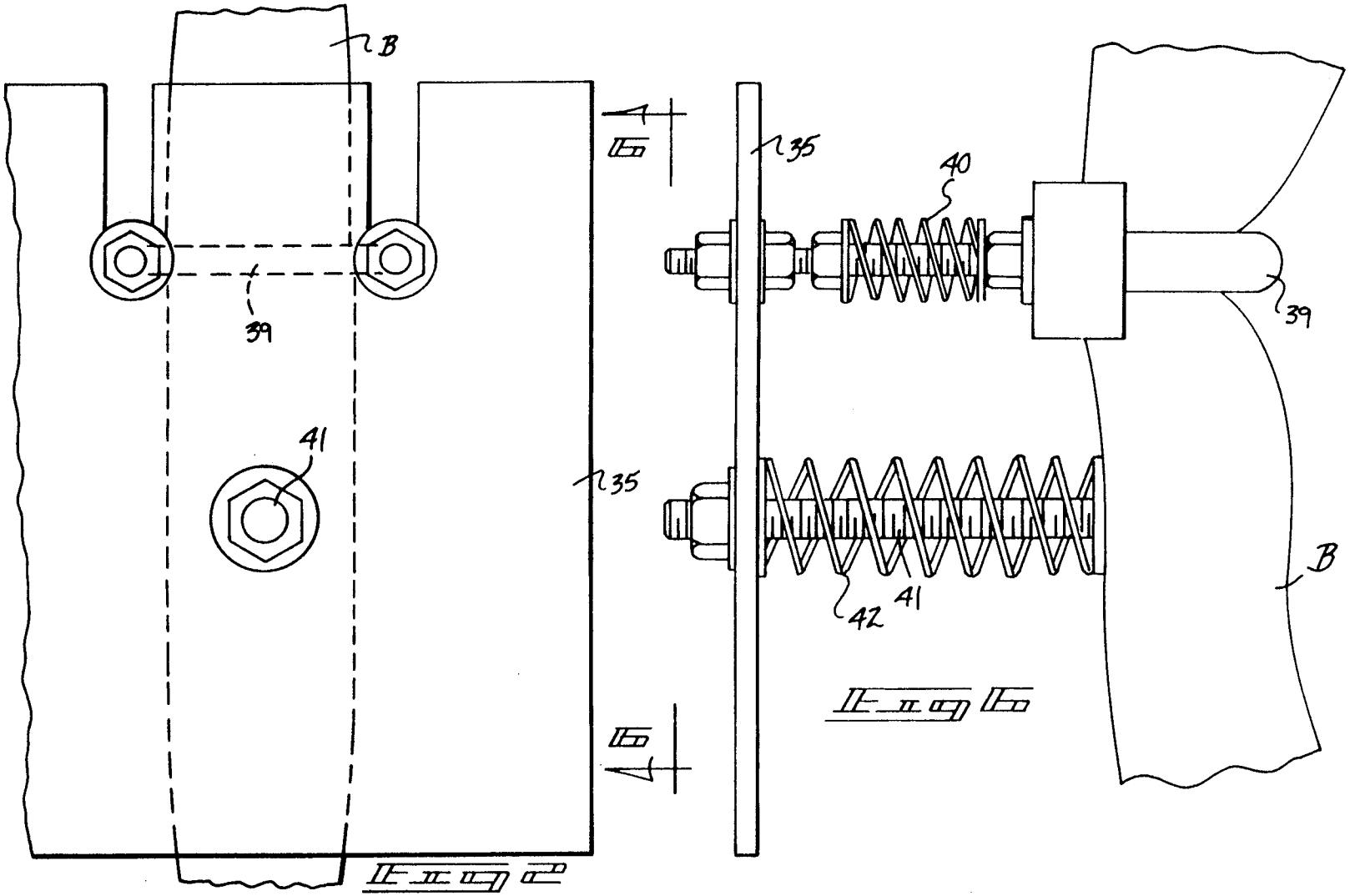
FIG. 6 is an orthographic side view of the bow mounting plate structure.
FIG. 7 is an orthographic rear view of the support structure utilizing a drive wheel.

A plumb bob and support line 34 (see FIG. 10) are sighted along a setting line 34*a* to intersect upper and lower terminal ends of the bow "B". To permit vertical adjustment and positioning in alignment of the sighting line 34*a*, a bow mounting plate 35 includes (see FIGS. 5, 6, and 10) mounting "U" bolt 39 orthogonally directed through the mounting plate 35 to secure the bow "B" to the mounting plate. A mounting "U" bolt springs 40 positioned between the mounting plate 35 and the bow "B" effect tensioning of the bow "B" in relative position to the mounting plate, as illustrated in FIGS. 5 and 6. An adjusting rod 41 positioned below and medially between the mounting "U" bolt legs of the mounting "U" bolt 39 is threadedly directed through the mounting plate 35 and includes a rear terminal end impinging upon the bow "B" to effect rotation of the bow "B" upon the mounting "U" bolt 39 and thereby effects adjustment and vertically positioning of the bow "B" along the setting line 34*a*.

Figure 5A:
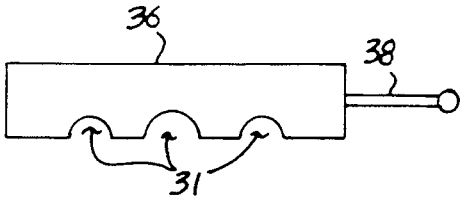
FIG. 5*a* is an orthographic front view of the engaged block utilized by the instant invention.
Figure 5:
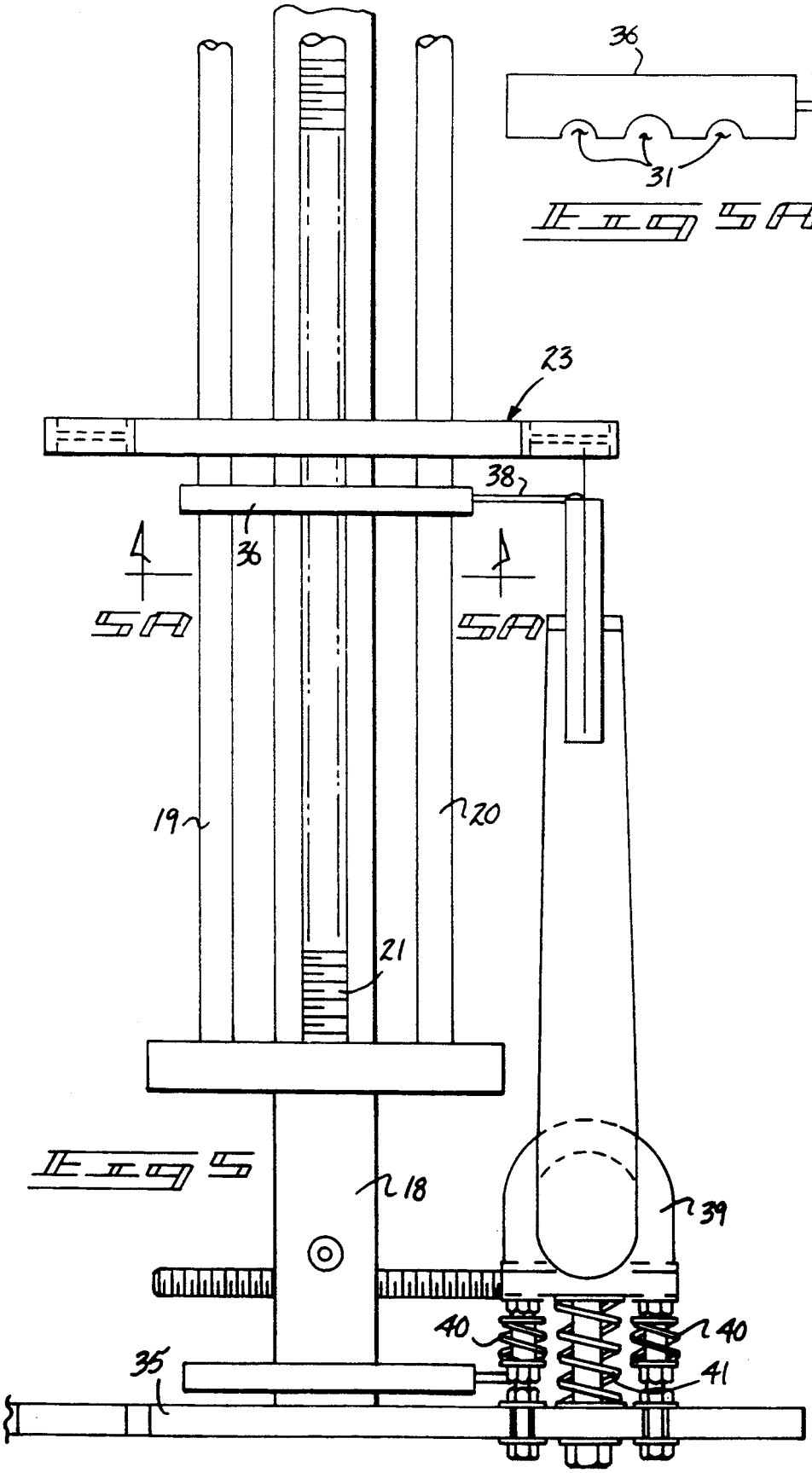
FIG. 5 is a partial orthographic top view of the instant invention.
Figure 7:
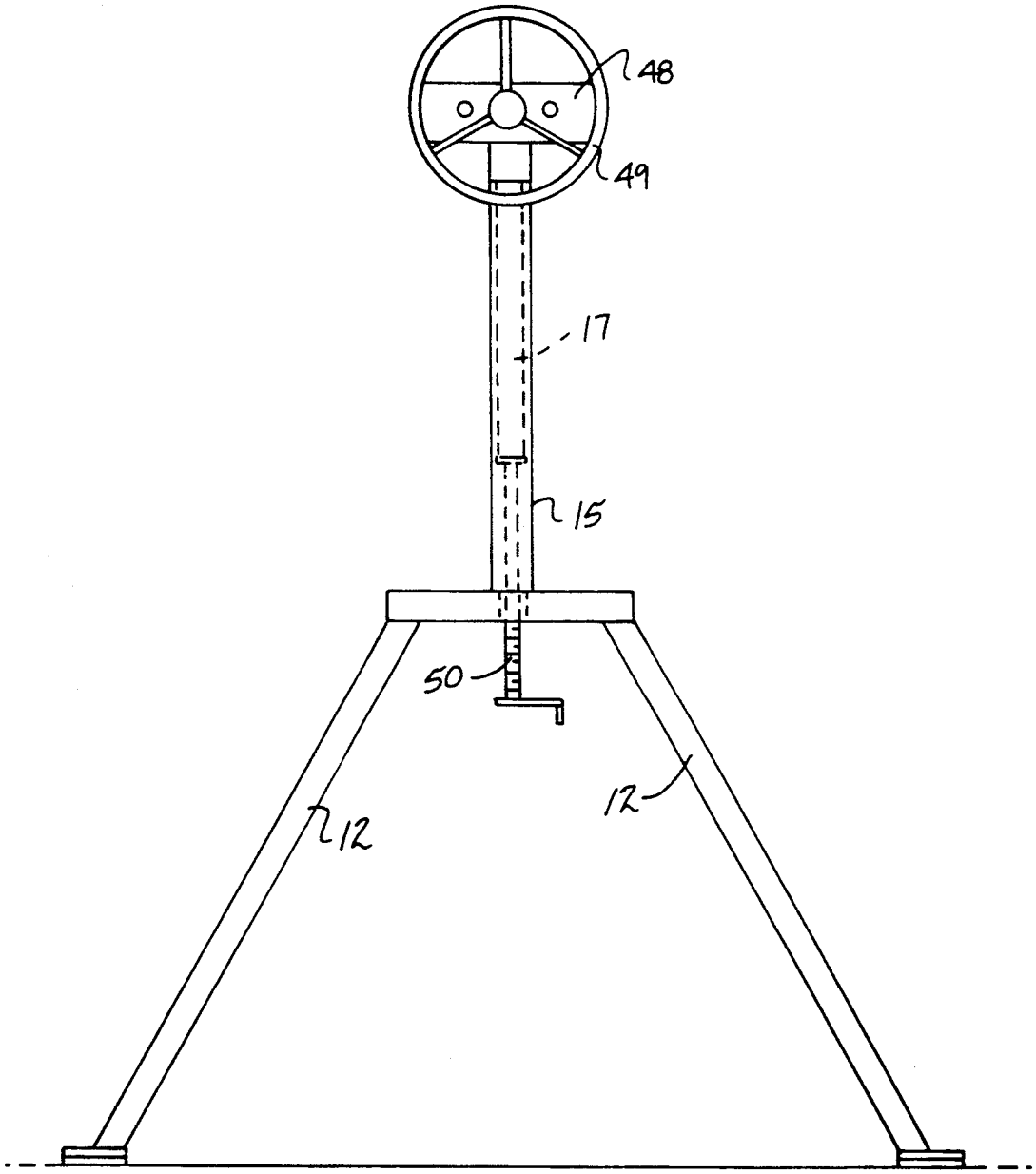
Figure 11:
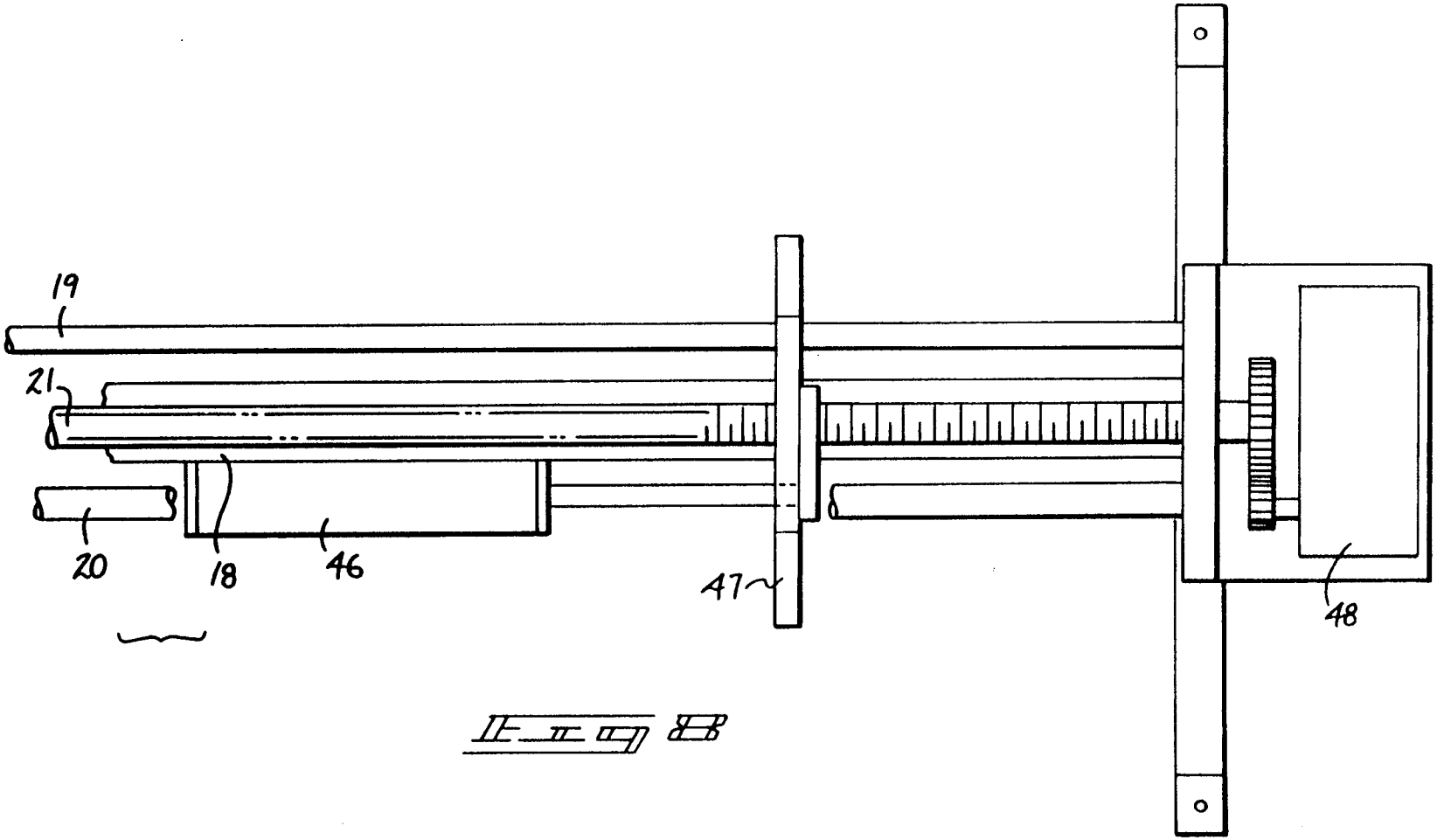

In retraction of the bow string "S", by the retraction member 23 as illustrated in FIG. 9 for example, a bow string gauge block 36 is positioned and received on the top surface of each respective right guide rail 19, left guide rail 20, and central drive screw 21 by the block 36 that includes a plurality of arcuate recesses 37 that are spaced apart a predetermined spacing substantially equal to a predetermined spacing defined between the respective right guide rail 19, left guide rail 20, and central drive screw 21 (see FIGS. 5 and 5*a*). A gauge block rod 38 projects orthogonally relative to the right and left guide rails 19 and 20 to provide positioning of the bow string retraction relative to the bow "B", as illustrated in FIG. 5.

Alternative devices are utilized to effect retraction of the bow string such as a pneumatic cylinder 46 (see FIG. 8) utilizing a support plate 47 mounting the pneumatic cylinder, or alternatively the use of a motorized gear drive 48 to effect selective rotation of the central drive screw 21. If desired, the central drive screw 21 may further utilize (see FIG. 7) a drive wheel 49 orthogonally mounted to a rear terminal end of the drive screw projecting exteriorly of the gear drive 48. Further, as illustrated in FIG. 7, a telescoping leg drive front rod 50 is mounted to each lower terminal end of each of the front and rear telescoping legs 16 and 17 to effect selective adjustment of each leg relative to the respective front and rear vertical posts 14 and 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery bow sighting apparatus, comprising, a support framework, the support framework including a plurality of front legs spaced from and parallel to a plurality of rear legs, and a lower horizontal support beam orthogonally directed between the front and rear legs, and a front vertical post orthogonally mounted to a forward terminal end of the horizontal support beam, and a rear vertical post mounted to a rear terminal end of the horizontal support beam, and a front telescoping leg telescopingly mounted within the front vertical post, and a rear telescoping leg vertically mounted within the rear vertical post, with the front and rear telescoping legs vertically and adjustably received within the front and rear vertical post, and a top horizontal support beam orthogonally mounted to an upper terminal end of the front telescoping leg and an upper terminal end of the rear telescoping leg, the top horizontal support beam including a bow mounting plate mounted to a forward terminal end of the top horizontal support beam for securement of the bow member thereto, and a bow string retraction member slidably mounted on the top horizontal support beam to effect selective retraction of the bow string of the bow member, with the bow string retraction member reciprocatably mounted on the top horizontal support beam relative to the bow mounting plate, and the bow mounting plate includes a mounting "U" shaped bolt orthogonally directed through the bow mounting plate for receiving the bow member therewithin, the mounting "U" bolt including a plurality of "U" bolt legs directed through a bow mounting plate, and an adjusting rod positioned below and medically between the "U" bolt legs to effect pivotment of the mounting "U" bolt relative to the bow mounting plate, with the adjusting rod threadedly directed through the bow mounting plate and including an adjusting rod rear terminal end impinging upon the bow member.

2. An apparatus as set forth in claim 1 including a plumb bob and tether line mounted to an upper terminal end of the bow member to define a vertical sighting line in adjusting of the bow member relative to the bow mounting plate.

3. An apparatus as set forth in claim 2 wherein the top horizontal support beam includes a right guide rail and a left guide rail, each arranged parallel relative to one another and on opposed longitudinal sides of the top horizontal support beam, and a central drive screw positioned medially between the right guide rail and the left guide rail, and the bow string retraction member including a threaded central opening threadedly receiving the central drive screw therebetween and further including the right guide rail and left guide rail slidably received through the bow string retraction member to orient in a parallel relationship the retraction member relative to the bow mounting plate.

4. An apparatus as set forth in claim 3 wherein the bow string retraction member further includes a retraction member lower horizontal support plate fixedly mounted to a top surface of the bow string retraction member, and the retraction member vertical plate including a retraction member lower horizontal support plate orthogonally mounted to a rear surface of the retraction member vertical plate, and the retraction member lower horizontal support plate including an adjusting slot and lock screw directed therethrough to effect selective sliding relationship of the retraction member lower horizontal support plate relative to the retraction member vertical plate, and a retraction member upper horizontal support plate fixedly mounted to the retraction member vertical plate above the lower horizontal support plate, with the upper horizontal support plate including a receiving slot directed through a forward edge thereof to receive a bow string therewithin, and the receiving slot including a release pin orthogonally directed into the receiving slot to effect selective arrest of the bow string within the receiving slot.

5. An apparatus as set forth in claim 4 wherein the retraction member vertical plate includes a peep sight vertical support blade fixedly mounted to an upper terminal end of the retraction member vertical plate and extending above the retraction member vertical plate, with the peep sight vertical support blade including a support blade slot longitudinally directed through the peep sight vertical blade, and a peep sight member adjustably mounted within the peep sight vertical support blade and projecting laterally thereof for sighting of an arrow projected by release of the bow string relative to the bow member.

6. An apparatus as set forth in claim 5 including a bow string gauge block, the gauge block including a plurality of arcuate recesses, the recesses spaced apart a predetermined spacing, and the right guide rail, the left guide rail, and the central drive screw spaced apart a spacing equal to the predetermined spacing, whereupon the bow string gauge block is mounted upon the right guide rail, the left guide rail, and the central drive screw, and the bow string gauge block includes a gauge block rod mounted to the gauge block projecting orthogonally relative to the right guide rail and the left guide rail for effecting visual gauging of rearward retraction of the bow string relative to the bow member.

7. An apparatus as set forth in claim 6 wherein the central drive screw includes a motorized gear drive mounted to a rear terminal end of the central drive screw, and the central drive screw directed through the motorized gear drive, including a drive wheel mounted to a rear terminal end of the central drive screw to effect selective motorized or manual rotation of the central drive screw.

* * * * *